US005599282A

United States Patent [19]

Ito

[11] Patent Number: 5,599,282

[45] Date of Patent: Feb. 4, 1997

[54] MASSAGER OF ROLLER TYPE WITH SPLINED SHAFT

[76] Inventor: Takakazu Ito, 1-866, Kami Higashiozone-cho, Kita-ku, Nagoya (462), Japan

[21] Appl. No.: 383,194

[22] Filed: Feb. 3, 1995

[51] Int. Cl.[6] ..... A61H 7/00

[52] U.S. Cl. ..... 601/94; 600/102

[58] Field of Search ..... 601/92, 93, 94, 601/90, 97–9, 84–6, 115, 116, 65; 600/9

[56] References Cited

U.S. PATENT DOCUMENTS

| | | | |
|---|---|---|---|
| 3,374,784 | 3/1968 | Brent et al. | 601/94 |
| 4,422,449 | 12/1983 | Hamabe | 601/99 |
| 4,454,867 | 6/1984 | Swanson | 601/115 |
| 4,599,997 | 7/1986 | Bucher | 601/65 |
| 5,323,499 | 6/1994 | Chan | 600/9 |

*Primary Examiner*—Max Hindenburg
*Assistant Examiner*—Pamela L. Wingood
*Attorney, Agent, or Firm*—Emmanuel J. Lobato; Burns & Lobato, P.C.

[57] ABSTRACT

A massager having a massage unit provided with elongate coaxial massage rollers rotational on a common axis in a common plane extending above the unit transversely of a travel path defined by a pair of laterally spaced parallel racks on which the unit reciprocably travels on two pairs of gears on opposite sides of the unit and engaged with the racks. A reversible electric motor provides all the necessary drive and associated coupling elements couple the electric motor for drive of the massage rollers and gears for reciprocable travel of the massage unit. The unit has a rotationally driven splined shaft on which is disposed circumferentially a tubular support for the axis of the massage rollers and which has a keyway for receiving splines of the splined shaft for rotation of the support with the splined shaft and allowing the relative axial movement therebetween so the massage rollers can be selectively rotated about the axis of the splined shaft and reciprocated upwardly and downwardly of this axis and relative to the massage unit. The various movements of the massage rollers can be effected selectively independently of each other and when the unit is stationary or traveling.

5 Claims, 7 Drawing Sheets

MASSAGER OF ROLLER TYPE WITH SPLINED SHAFT

BACKGROUND OF THE INVENTION

1. Field of the Invention

The present invention relates to a massager of a roller type adapted to massage back and/or hips of a user sitting down or upright on a chair or lying on a mat by rollers incorporated in the chair of mat so as to roll on the back and/or the hips, respectively, exerting appropriate pressure thereupon.

2. Description of the Prior Art

The massager of roller type is well known which contains within the back and/or seat of a chair or within a mat rollers so as to massage the back and/or the hips of a user.

However, with the massager of prior art, the rollers are reciprocated in a single direction and a substantially limited area is massaged in a fixed direction. Consequently, it has been found that the affected part of user's body is often left insufficiently massaged.

SUMMARY OF THE INVENTION

The massager according to the invention overcomes the problem above. It provides a massager comprising a massage unit that travels in opposite directions along a rectilinear travel path so that massaging is effected along a substantial area of the body parts of a user. Two elongate massage rollers provide massaging pressure by individual rotation on a common axis and are rotationally driven in a circular path about a vertical axis and are reciprocably driven up and down on the vertical axis. The driving of the massage rollers takes place selectively for each type of movement either jointly and simultaneously or each movement is effected individually at will by a reversible electric motor. The massage roller movements can take place while the massage unit is stationary or while traveling along its rectilinear travel path so that massage coverage of the user body parts is over substantial areas.

DESCRIPTION OF THE PREFERRED EMBODIMENT

The invention will be more readily understood from the following detailed description of a specific embodiment in reference with the accompanying drawings.

Figure 1:
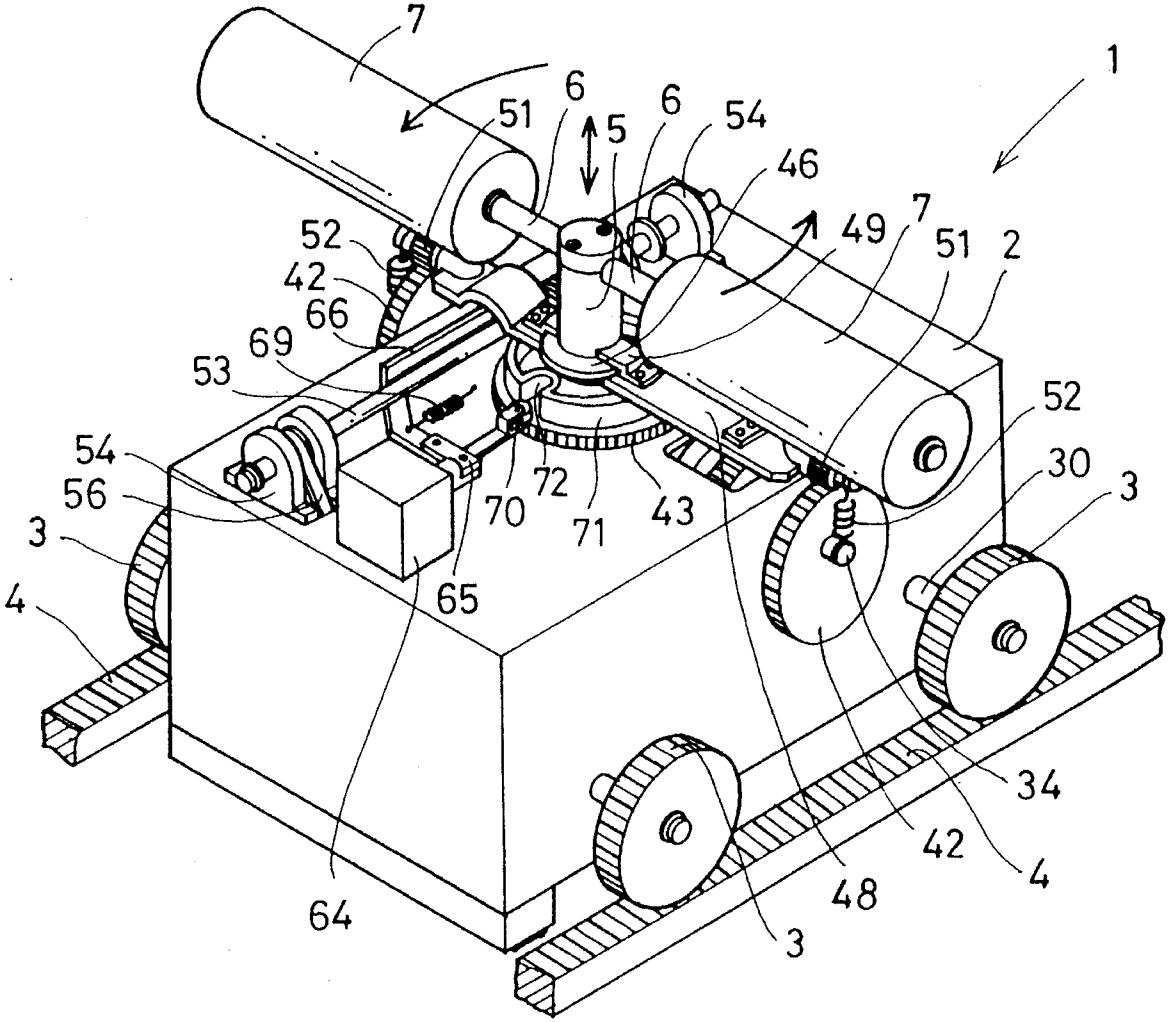
FIG. 1 is a perspective view exemplarily showing the massager of the invention.

Referring to FIG. 1, reference numeral 1 designates a basic massaging mechanism comprising a box 2, travelling gears 3 carried by the box 2 on both sides thereof adapted to be engaged with associated rail-like racks 4 so that the box 2 reciprocates on the racks 4 as the travelling gears 3 are rotated in alternate directions and stopped at a desired position as the travelling gears 3 are controllably stopped. Two rollers 7 are rotatably supported by respective arms 6 laterally extending from opposite sides of a support 5 which is, in turn, supported on a top of the box 2 at a center thereof so that the rollers 7 simultaneously effect up-and-down motion and one-directional circular motion as the support 5 moves in the same motions. With the basic massaging mechanism 1 incorporated in a chair or mat so that the rollers 7 may bear against the back and/or the hips of user, the rollers 7 roll on the back and/or the hips as they describe a circle in one direction while moving up and down and thereby massage the above-mentioned regions of the user's body.

Figure 2:
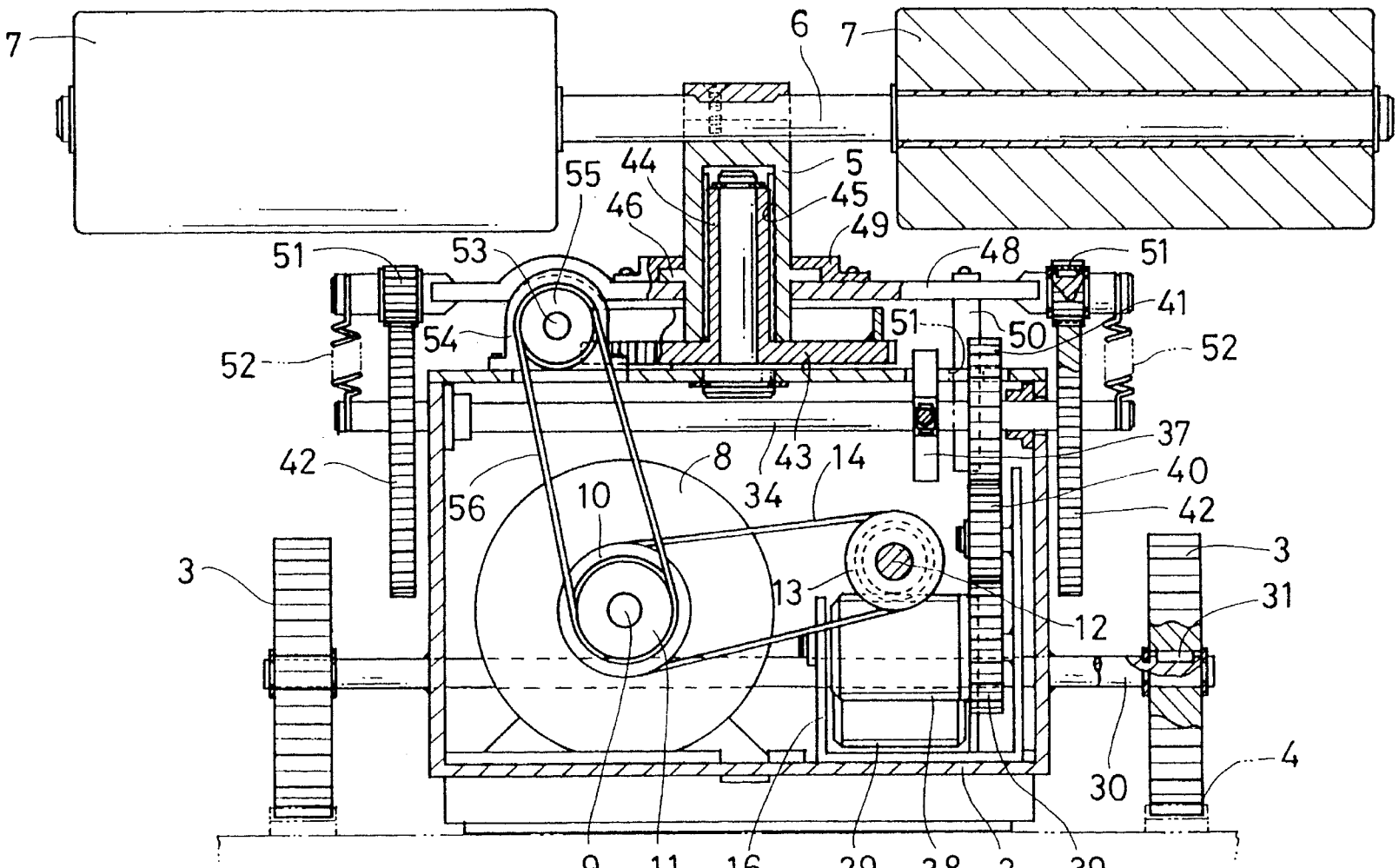
FIG. 2 is a sectional front view of this massger.

Referring to FIG. 2 illustrating the invention in a sectional front view, the box 2 contains therein a speed variable reversible motor 8 having an output shaft 9 to which a fist pulley 10 as well as a second pulley 11 are fixed and a belt 14 is disposed about the first pulley 10 and a pulley 13 fixed to a first shaft 12 extending across the interior of the box 2.

Figure 3:
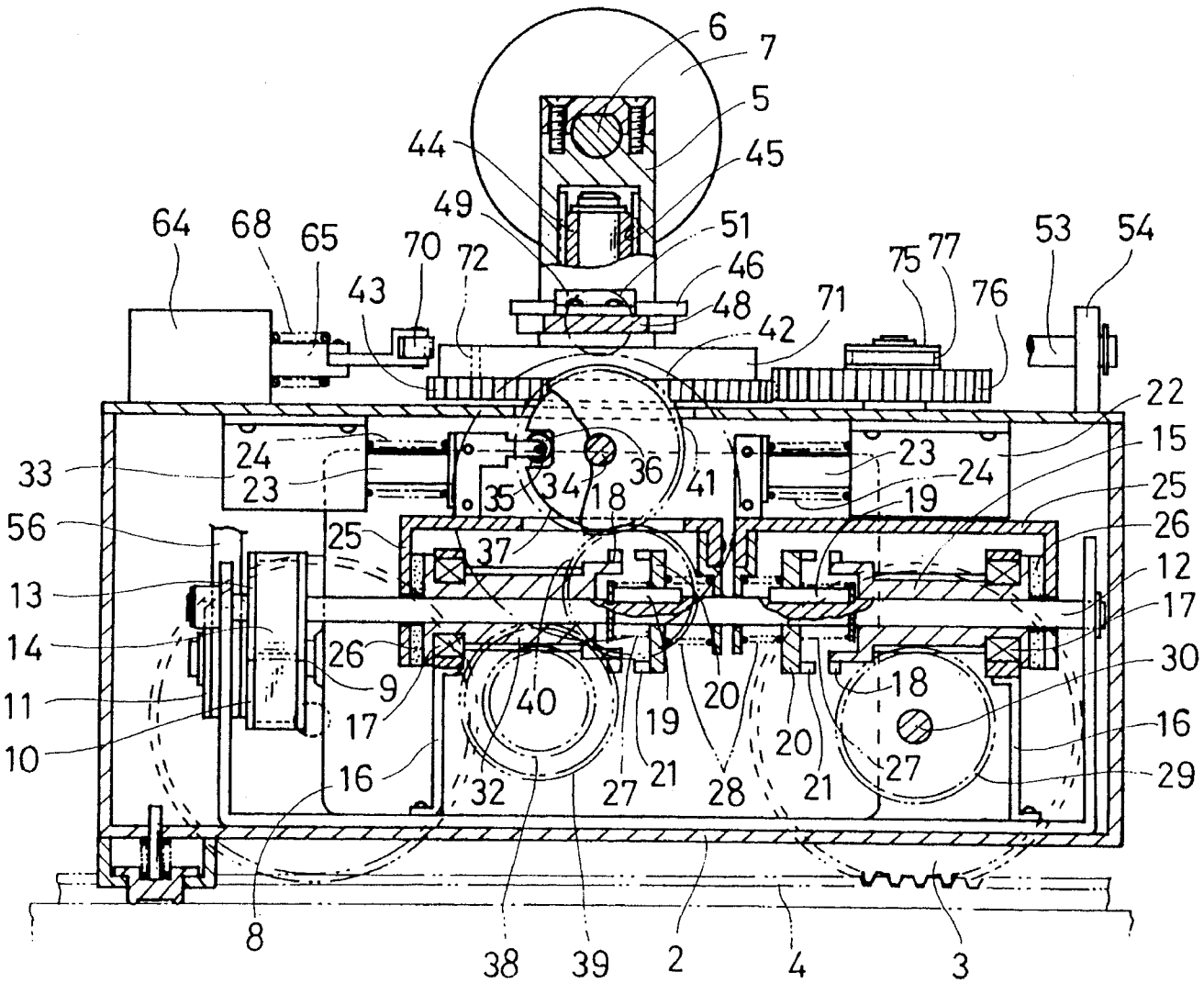
FIG. 3 is a sectional side view of the massager with a first solenoid being deenergized.
Figure 4:
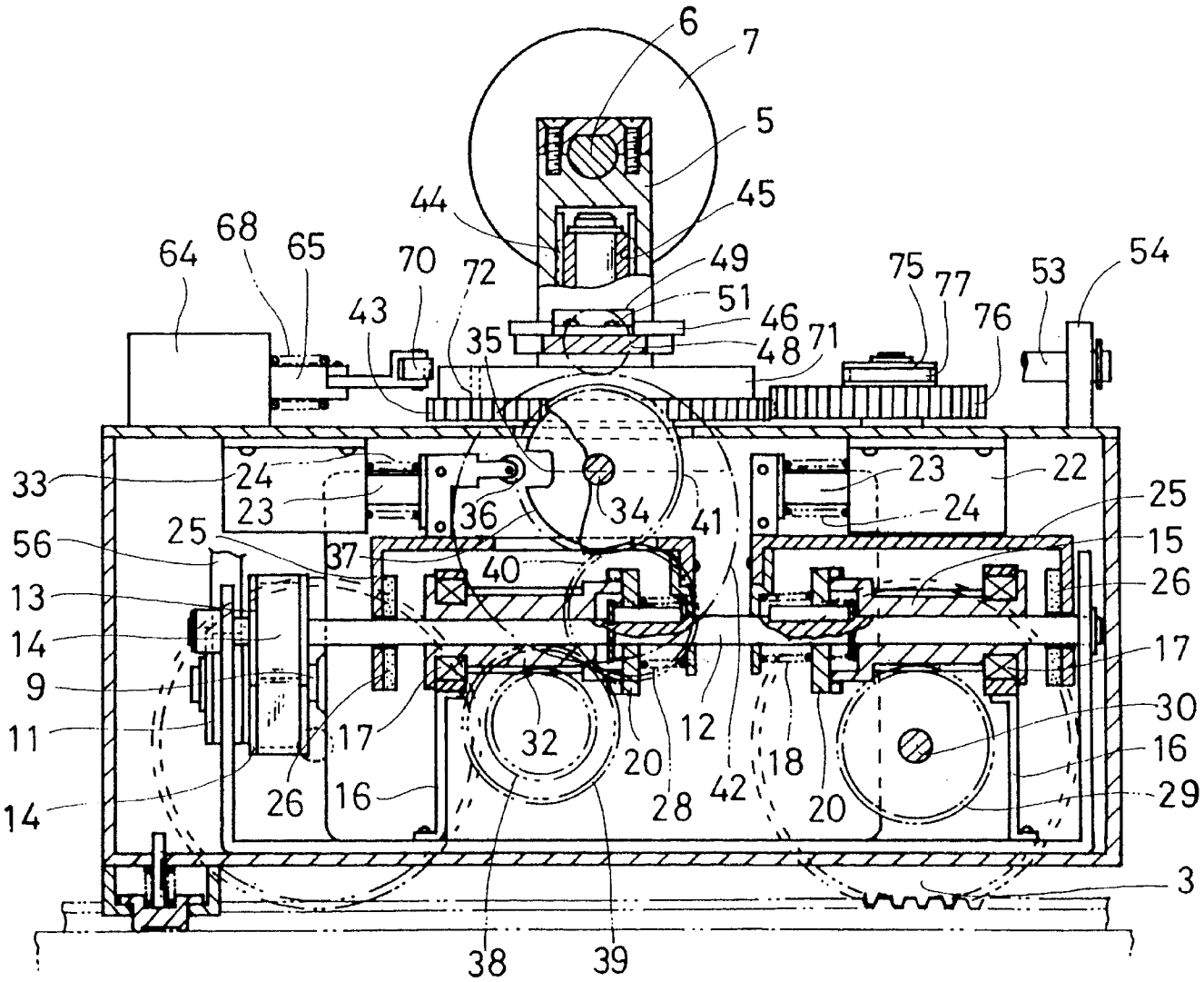
FIG. 4 is a view similar to FIG. 3 but with the first solenoid being energized.

Referring to FIGS. 3 and 4 illustrating the invention in a sectional side view, there is provided around the first shaft 12 at the right side thereof as viewed in FIGS. 3 and 4 a first worm gear 15 formed with a clutch claw 18, which is supported by a bearing 17 of a support 16 so as to be rotatable relative to the first shaft 12. Opposed to the left end of the first worm gear 15, a clutch 20 having a claw 21 is mounted by a key 19 on the first shaft 12 so as to be axially slidable but not rotatable relative to the first shaft 12.

Above the first worm gear 15, the ceiling of the box 2 carries a first solenoid 22 having a plunger 23 normally thrusted out leftward under the biasing effect of a spring 24 and the plunger 23 is provided at an end with an arm 25 of inverted U-shape straddling the first worm gear 15 as well as the clutch 20. When the first solenoid 22 is deenergized, the right end of the arm 25 urges a brake disc 26 under the biasing effect of the spring 24 to brake the first worm gear 15 and the clutch 20 is held under a combined biasing effect of a soft spring 27 and a hard or stronger spring 28 to be spaced from the first worm gear 15, as will be seen in FIG. 3.

A worm wheel 29 engaged with the first worm gear 15 having an axle 30 fixedly extending through the center thereof, said axle 30 further extending outward from the opposite side walls of the box 2 and the respective travelling gears 3 are fixed by keys 31 on the opposite ends of the axle 30.

When the first solenoid 22 is energized during rotation of the reversible motor 8, the plunger 23 retracts and the arm 25 moves rightward as will be seen in FIG. 4. The clutch 20 slides on the key 19 under biasing effeft of the hard spring 28 as the brake disc 26 is spaced from the first worm gear 15, so that the claw 21 is engaged with the clutch claw 18 to rotate the first worm gear 15, thus the travelling gears 3 rotate together with the worm wheel 29 engaged with the first worm gear 15 and travel on the respective racks 4.

A manual switch (not shown) or a limit switch provided at each end of the travelling course may be operated and thereby the rotating direction of the reversible motor 8 may be reversed to switch the travelling direction and a revolving speed of the reversible motor 8 may be controllably varied to adjust the travelling speed.

As the first solenoid 22 is deenergized, it restores the position shown by FIG. 3 at which the claw 21 of the clutch 20 is disengaged from the clutch claw 18 and the brake disc 26 is urged against the first worm gear 15 to brake it and thereby to brake the travelling gears 3.

Similarly, there is provided around the first shaft 12 at the left side thereof as viewed in FIGS. 3 and 4 a second worm gear 32 formed with a clutch claw 18, which is supported by a bearing 17 of a support 16 so as to be rotatable relative to the first shaft 12. Opposed to the right end of the second worm gear 32, a clutch 20 having a claw 21 is mounted by a key 19 on the first shaft 12 so as to be axially slidable but not rotatable relative to the first shaft 12.

Above the second worm shaft 32, the ceiling of the box 2 carries a second solenoid 33 having a plunger 23 normally thrust out rightward under the biasing effect of a spring 24 and the plunger 23 is provided at an end with an arm of inverted U-shape straddling the second worm gear 32 as well as the clutch 20. When the second solenoid 33 is deenergized, the left end of the arm 25 urges a brake disc 26 under biasing effect of the spring 24 to brake the second worm gear 32, the clutch 20 is held under a combined biasing effect of a soft spring 27 and a hard spring 28 to be spaced from the second worm gear 32 and a roller 36 rotatably supported by the forward end of the plunger 23 is received in a notch formed in a disc 37 which is fixed on a second shaft 34 extending across the interior of the box 2.

A worm wheel 38 is engaged with the second worm gear 32, and a gear 39 coaxially fixed to the worm wheel 38 is engaged with a gear 40 which is, in turn, engaged with a gear 41 fixedly mounted on the second shaft 34. Opposite ends of this second shaft 34 extending outward through the box 2 carry thereon eccentric gears 42, respectively.

Figure 5:
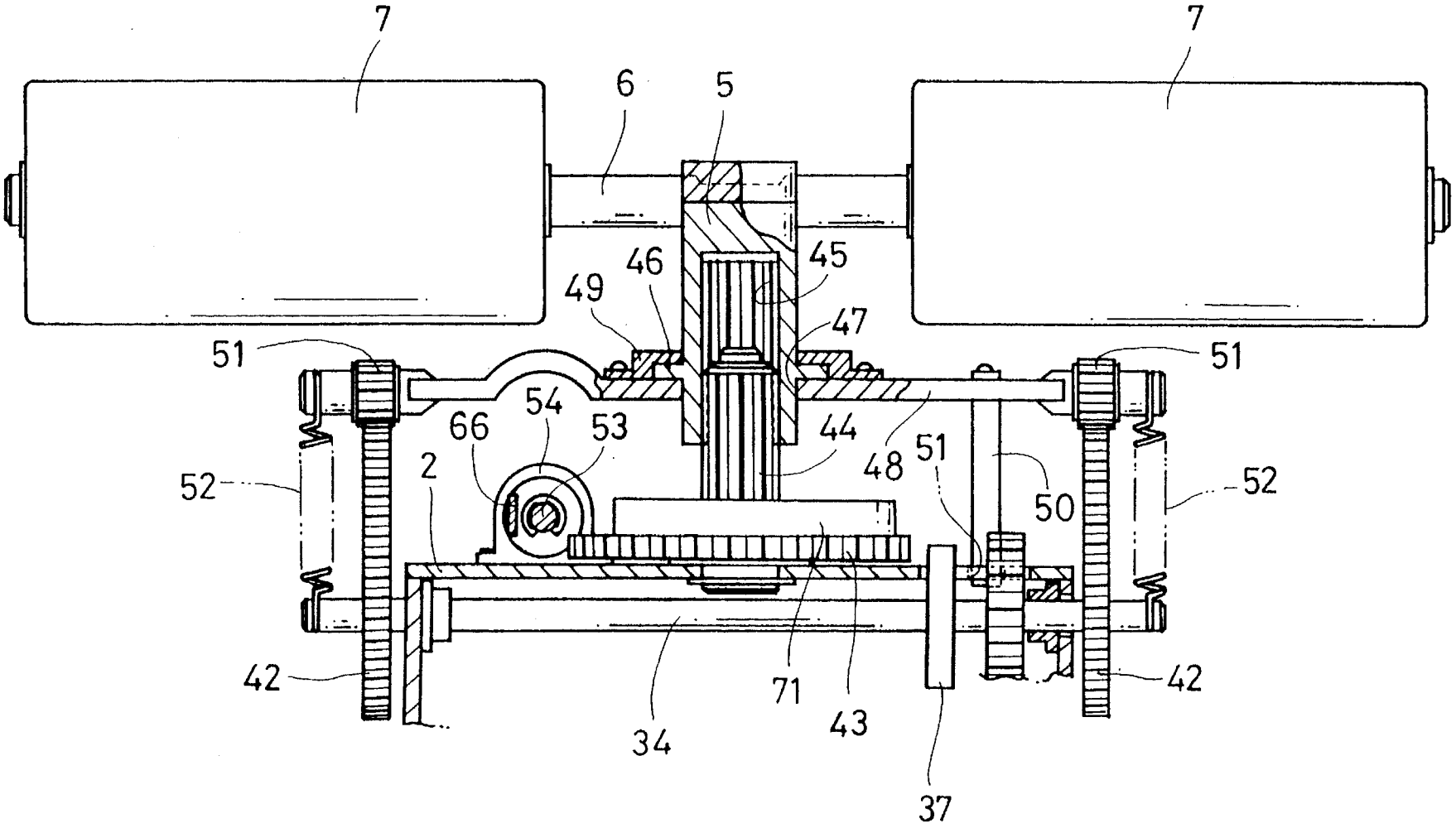
FIG. 5 is a sectional front view showing, in an enlarged scale, a mechanism for up-and-down motion of rollers.

As shown in an enlarged scale by FIG. 5, a gear 43 centrally provided with a spline shaft 44 planted integrally thereon is rotatably supported on the top of the box 2 and the support 5 has female splines 45 adapted to be engaged over the spline shaft 44 so that the support 5 may be slidably moved up and down. The support 5 is formed around its outer periphery with a flange 46. There is provided a supporting arm 48 centrally formed with an opening 47 for loosely receiving the support 5 and having a pair of pressure plates 49 fixed on its top surface for loosely holding the flange 46. To prevent the supporting arm 48 from oscillating, a holder plate 50 is inserted into a guide hole 51 formed in the top wall of the box 2.

Pinions 51 are rotatably mounted on opposite ends of the arm 48, respectively, so as to be engaged with the respective eccentric gears 42 and tension springs 52 are suspended between the respective ends of the arm 48 and the associated ends of the second shaft 34 in order to bias the pinions 51 to be in engagement with the respective eccentric gears 42.

When the second solenoid 33 is energized during rotation of the reversible motor 8, the plunger 23 and therefore the roller 36 retract away from the notch 35 of the disc 37, the arm 25 moves leftward, the brake disc 26 is disengaged from the second worm gear 32, the clutch 20 slides along the key 19 under biasing effect of the hard spring 28 so as to engage the claw 21 with the clutch claw 18, resultifng in rotation of the second worm gear 32, and rotation of the worm wheel 38 being engaged with the second worm gear 32 causes the gears 39, 40 and 41 to rotate the eccentric gears 42 around the second shaft 34, as best seen in FIG. 4.

Thereupon, engagement between the eccentric gears 42 and the pinions 51 causes the arm 48 to be moved up and down together with the support 5 and causes also the rollers 7 to be moved up and down.

Up-and-down motion of the rollers 7 is terminated asd follows: Deenergization of the second solenoid 33 causes the plunger 23 to be advanced first until the roller 36 rolls on the periphery of the disc 37 and then further advanced until the roller 36 is received in the notch 35, whereupon the arm 25 moves rightward until the clutch 20 is let out. Consequently, the brake disc 26 brakes the second worm gear 32 and thereby terminates up-and-down motion of the rollers 7.

At this moment, the rollers 7 are necessarily located at their lowermost positions at which the rollers 7 can easily move, since the roller 36 has been received in the notch 35 of the disc 37.

Frequency at which the rollers 7 move up and down can be varied by adjusting the revolving speed of the reversible motor 8.

On the top of the box 2, a third shaft 53 is rotatably supported by bearings 54 and a belt 56 is disposed about a pulley 55 mounted in axially slidable but not rotatable manner by a key 57 on and relative to the third shaft 53 and the second pulley 11 fixed to the output shaft 9 of the reversible motor 8.

A third corm gear 58 formed on its right end with a clutch claw 59 is supported by the bearings 54 in axially slidable and rotatable manner on and relative to the third shaft 53 and a clutch 61 is slidably mounted by a key 60 on this third shaft 53 so that the clutch 61 is held to be spaced from the third worm gear 58 under a combined biasing effect of the hard spring 28 suspended between the clutch 61 and a first ring 62 and the soft spring 27 suspended between the clutch 61 and the third worm gear 58.

A second ring 63 is fixed on the third shaft 53 on the left side of the middle one of the bearings 54.

A third solenoid 64 is provided on the top of the box 2 and a forward end of an arm 66 connected to a plunger 65 associated with the third solenoid 64 extend rightward slightly beyond the second ring 63. A brake disc 67 is welded to the forward end surface of the arm 66.

The plunger 65 is biased by a combined effect of a compression spring 68 and a tension spring 69 to be thrust out and a roller 70 rotatably supported on the forward end of the plunger 65 is opposed to an annular wall 71 provided on the top of the gear 43. The annular wall 71 is formed with a notch 72.

A worm wheel 73 is in engagement with the third worm gear 58 and a belt 77 is draped about a pulley 74 coaxial and integral with the worm wheel 73 and a pulley 75 coaxial and integral with a gear 76 engaged with the gear 43.

Figure 7:
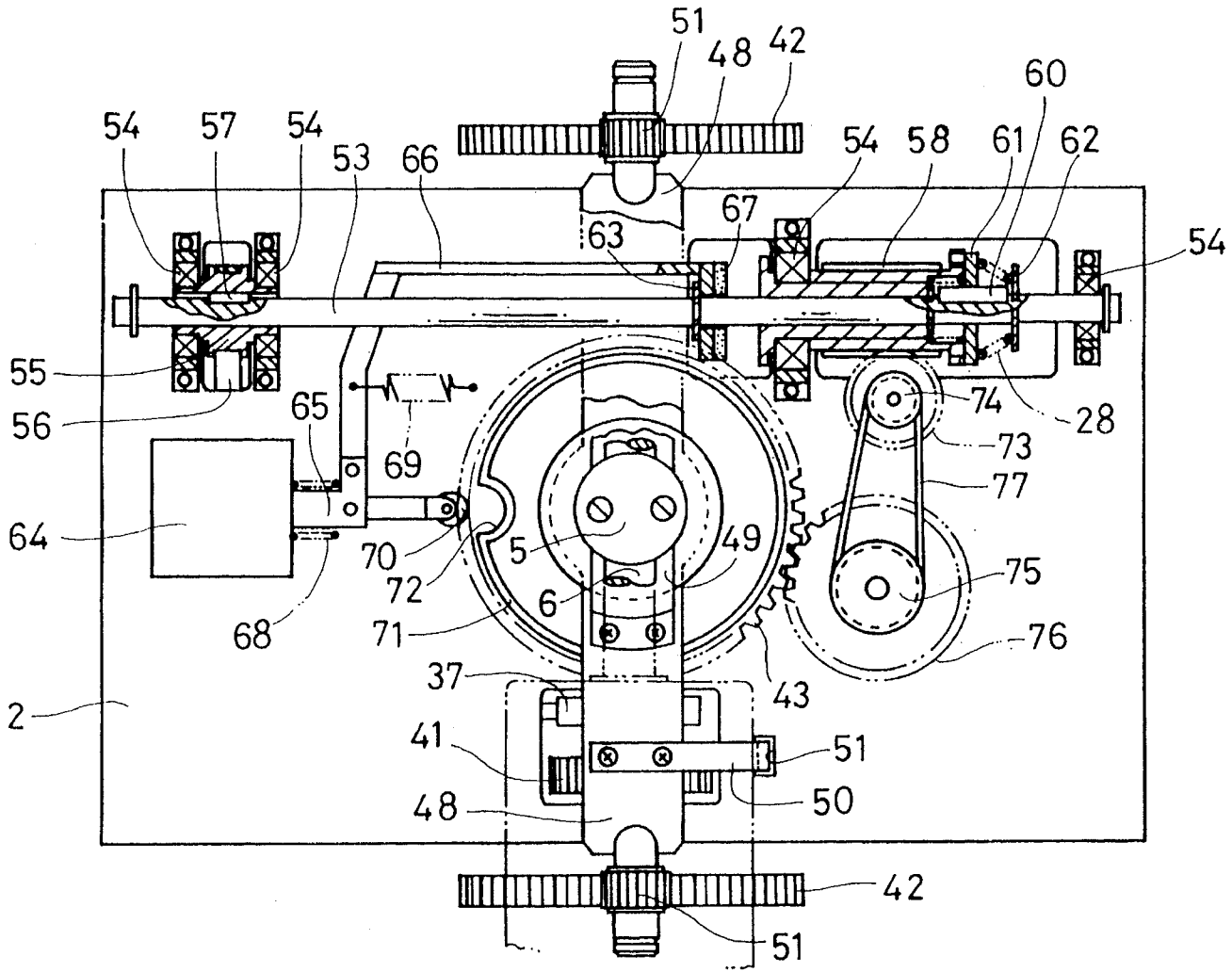
FIG. 7 is a view similar to FIG. 6 but with the third solenoid being energized.

When the third solenoid 64 is energized during rotation of the reversible motor 8, the arm 66 moves leftward together with the plunger 65 and the third shaft 53 also moves leftward, as best seen in FIG. 7, whereupon the brake disc 67 is disengaged from the third worm gear 58, simultaneously the clutch 61 is biased leftward by the hard spring 28 to be engaged with the clutch claw 59 of the thir worm gear 58 and the third worm gear 58 is rotated together with the third shaft 53. This rotation is transmitted by the worm wheel 73, the pulley 74, the belt 77, the pulley 75 and the gear 76 to the gear 43 which, in turn, rotates the spline shaft 44 and the support 5 having the female splines 45 in engagement therewith, the latter being rotated with the flange 46 loosely held between the supporting arm 48 and the pressure plates 49. In this manner, a desired circular motion of the rollers 7 is obtained around the support 5. The direction of this circular motion depends on the direction in which the reversible motor 8 operates.

Figure 6:
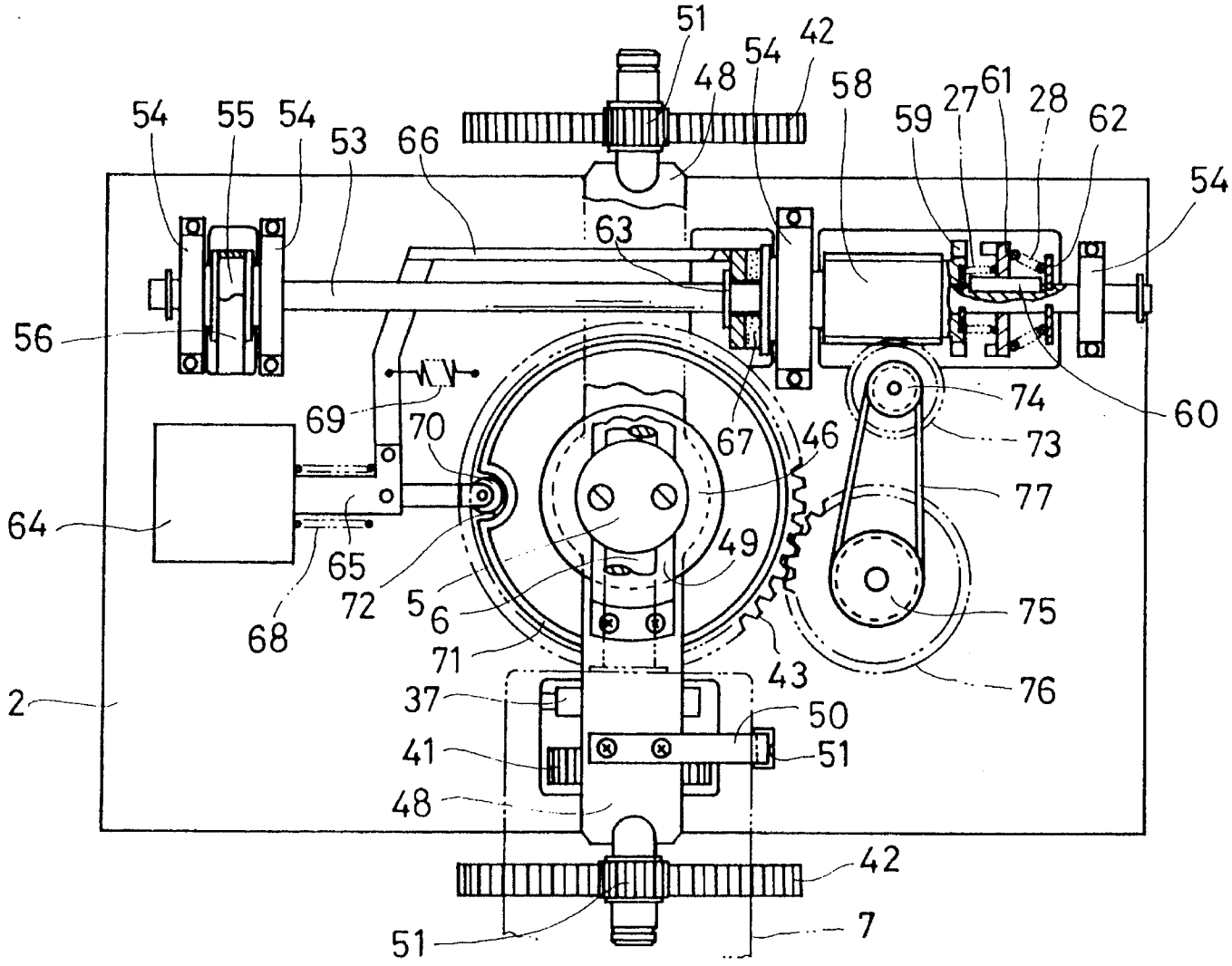
FIG. 6 is a plan view showing, as partially broken away, the massager with a third solenoid being deenergized.

When the third solenoid 64 is deenergized, the plunger 65 is advanced first until the roller 70 rolls on the annular wall 71 and then until the roller 70 is received in the notch 72, whereupon the plunger 65 is further advanced so as to move the third shaft 53 rightward, as best seen in FIG. 6. The clutch 61 is disengaged from the third worm gear 58 as the brake disc 67 bears against the third worm gear 58, and rotation of the third worm gear 58 and therefore the circular motion of the rollers 7 are terminated.

Now a common axis of the rollers 7 is orthogonal to the direction in which the box 2 travels since the roller 70 is in engagement with the notch 72 of the annular wall 71. Namely, the rollers 7 roll on the surface to be massaged with their common axis being orthogonal to the direction in which the box 2 travels.

As will be apparent from the foregoing description, this embodiment is so arranged that the first solenoid 22, the second solenoid 33 and the third solenoid 64 may be selectively energized or deenergized to obtain rectilinear reciprocating motion, up-and-down motion and circular motion of the rollers required to massage the affected part, separately or in operative assocition with one another.

It should be understood that the rollers 7 are preferably made of suitable magnetic material to facilitate the blood circulation in the affected part.

What is claimed is:

1. A massager for incorporation into a seat or back of a chair including an inclinable chair and mat for massaging the back and/or hips of a user sitting upright on a chair or reclining comprising:

a massage unit having mounted thereon two pairs of gears on opposite sides of the unit driven rotationally selectively for reciprocably driving the massage unit along a rectilinear travel path in opposite directions;

a pair of laterally spaced, parallel racks defining said travel path and along which said gears travel for reciprocably driving the massage unit;

a pair of elongate massage rollers mounted rotationally on a common axis extending away from each other in a commmon plane above said massage unit extending in a direction tranversely of said travel path;

a splined shaft having a longitudinal spline and extending upwardly on said massage unit;

a support on said splined shaft for the axis of said massage rollers having a keyway into which said spline fits for rotating the support when the splined shaft is rotated and allowing relative axial movement between the splined shaft and said support;

drive means for selectively effecting massaging on body parts of a user comprising means for selectively rotationally driving said splined shaft for rotating said support for the axis of the massage rollers and rotating the massage rollers about an axis of the splined shaft in said common plane extending transversely of the travel path, and means for selectively reciprocating the support axially of the splined shaft upwardly and downwardly relative to the massage unit for moving the massage rollers upwardly and downwardly while the splined shaft is rotationally driven or alternatively while the splined shaft is stationary;

and said drive means comprising means for effecting said massaging while said massage unit is stationary or reciprocably driven on said travel path.

2. A massager according to claim 1, in which massage rollers are made of a magnetic material.

3. A massager according to claim 1, in which said support is tubular, and which the tubular support extends axially circumferentially of said splined shaft, the axis of the elongate rollers being disposed extending laterally from said tubular support and fixed thereto.

4. A massager according to claim 1, in which said drive means comprises a reversible electric motor.

5. A massager according to claim 4, in which said drive means comprises individual means for selectively coupling the splined shaft, the support for the axis of the massage rollers and the gears to said reversible electric motor.

* * * * *